US011618132B2

(12) United States Patent
Jenkins et al.

(10) Patent No.: US 11,618,132 B2
(45) Date of Patent: Apr. 4, 2023

(54) MAGNETIC CLAMPING APPARATUS

(71) Applicants: Steven Douglas Jenkins, Pilot hill, CA (US); Michael E. Gavin, Roseville, CA (US)

(72) Inventors: Steven Douglas Jenkins, Pilot hill, CA (US); Michael E. Gavin, Roseville, CA (US)

( * ) Notice: Subject to any disclaimer, the term of this patent is extended or adjusted under 35 U.S.C. 154(b) by 80 days.

(21) Appl. No.: 17/209,001

(22) Filed: Mar. 22, 2021

(65) Prior Publication Data

US 2021/0299824 A1 Sep. 30, 2021

Related U.S. Application Data

(60) Provisional application No. 62/992,767, filed on Mar. 26, 2020.

(51) Int. Cl.
*B25B 3/00* (2006.01)
*B25B 11/00* (2006.01)

(52) U.S. Cl.
CPC ..... *B25B 11/002* (2013.01)

(58) Field of Classification Search
CPC ..... B25B 11/00; B25B 11/002; B25B 11/02
See application file for complete search history.

(56) References Cited

U.S. PATENT DOCUMENTS 2,731,663 A 1/1956 Thompson
3,302,566 A 2/1967 Blanchet
5,584,414 A * 12/1996 Neubeck ..... A47J 36/06 220/753
6,477,749 B1 * 11/2002 Reiter ..... A41F 1/002 24/66.1
7,640,636 B2 * 1/2010 Clark ..... A44C 17/0216 24/303
8,464,377 B1 * 6/2013 Carson ..... A47G 9/0261 24/72.5
8,827,335 B2 9/2014 Tortelli
9,761,362 B2 9/2017 Nätti
10,272,713 B2 * 4/2019 Lam ..... B42F 5/00
2010/0308605 A1 * 12/2010 Fiedler ..... E05B 47/004 292/251.5
2012/0124786 A1 * 5/2012 Fiedler ..... A45C 13/1069 24/303
2021/0299824 A1 * 9/2021 Jenkins ..... B25B 11/002

OTHER PUBLICATIONS

Master Magnetics Strong Magnet, https://www.amazon.com/Master-Magnetics-Powerful-Ergonomic-07501/dp/B000J3RYMU.
Magnetic Grippers, https://www.goudsmitmagnets.com/en/solutions/magnetic-handling/lifting-handling-magnets/magnetic-grippers.

* cited by examiner

*Primary Examiner* — Lee D Wilson

(57) ABSTRACT

A magnetic clamping apparatus includes a magnetic base, a handle, a grip, and a central axis. The magnetic base includes a magnet body and a mounting body. The handle and the magnetic base are concentrically positioned around the central axis. The mounting body is concentrically connected onto the magnet body thus allowing the magnet body to attach ferrous metals. The handle is terminally connected to the mounting body, and the grip is connected around the handle so that the user can easily grasp and control the magnetic clamping apparatus.

9 Claims, 5 Drawing Sheets

MAGNETIC CLAMPING APPARATUS

The current application claims a priority to the U.S. Provisional Patent application Ser. No. 62/992,767 filed on Mar. 20, 2020. The current application is filed on Mar. 22, 2020 while Mar. 20, 2020 was on a weekend.

FIELD OF THE INVENTION

The present invention generally relates to a magnetic clamping apparatus. More specifically, the present invention relates to a handheld magnetic clamp used to hold together ferrous components of the metal stud framing systems used in construction.

BACKGROUND OF THE INVENTION

Building constructors require a great deal of tools in their trade to complete their projects. When artisans work on metal stud framing systems to provide buildings with mechanical strength and structure, one of the tools they may come across is mechanical clamps to secure metal studs to other metal framing components in order to attach the framing systems together. However, these mechanical clamps are not always feasible for the work at hand and sometimes there are situations where mechanical clamps are impractical and cannot be used in the working application. Because studs are constructed of ferrous metals, strong magnets such as neodymium magnets with a triple coating of nickel, copper, nickel may be used to securely clamp metal stud framing systems together for a mechanical fastener to be installed permanently connecting framing components together or connection to the building structure.

An objective of the present design is to provide the user with a handheld magnetic clamping apparatus for securing metal stud framing systems together or to the building structure. The magnetic tool features a magnet attached to a handle and a grip. The handle and grip provide leverage to allow the user to easily remove the magnet. Several magnetic fastening tools may be deployed at several points to secure heavier items such as long metal track along a ceiling, increasing the efficiency of work by allowing some aspects of work to be done by a single worker as opposed to multiple workers. Some examples of areas where precision and efficiency can be gained is building box headers and flushing out wall corners. The present invention may also be used for securing measuring tools to a surface to make hands-free measurements and be used in any other area where mechanical clamps are not feasible. Because the tool simply uses magnetic attachment, it is easy for artisans to relocate each tool for other situations or aspects of the job.

DETAIL DESCRIPTIONS OF THE INVENTION

All illustrations of the drawings are for the purpose of describing selected versions of the present invention and are not intended to limit the scope of the present invention.

Figure 1:
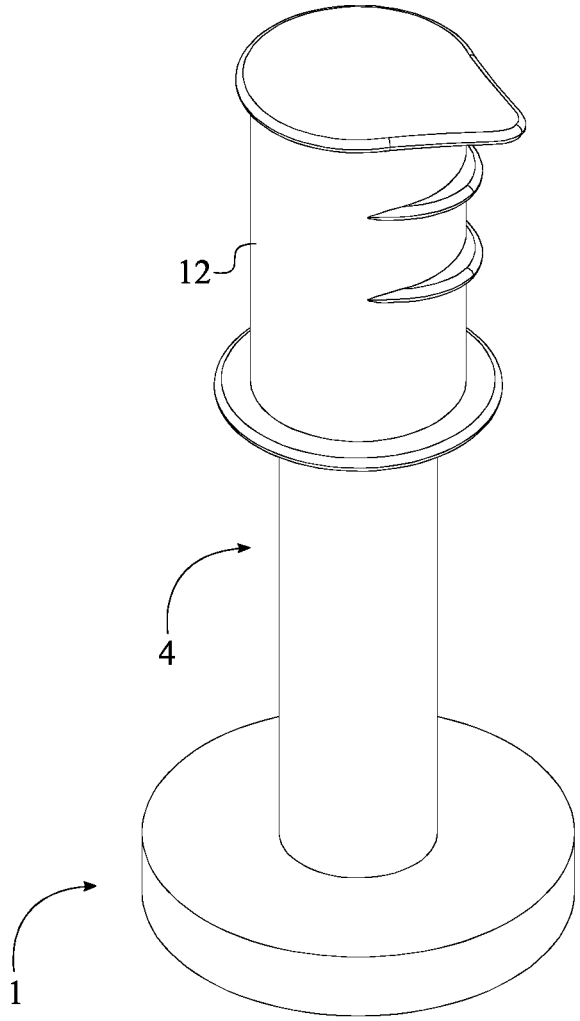
FIG. 1 is a perspective view of the present invention.
Figure 2:
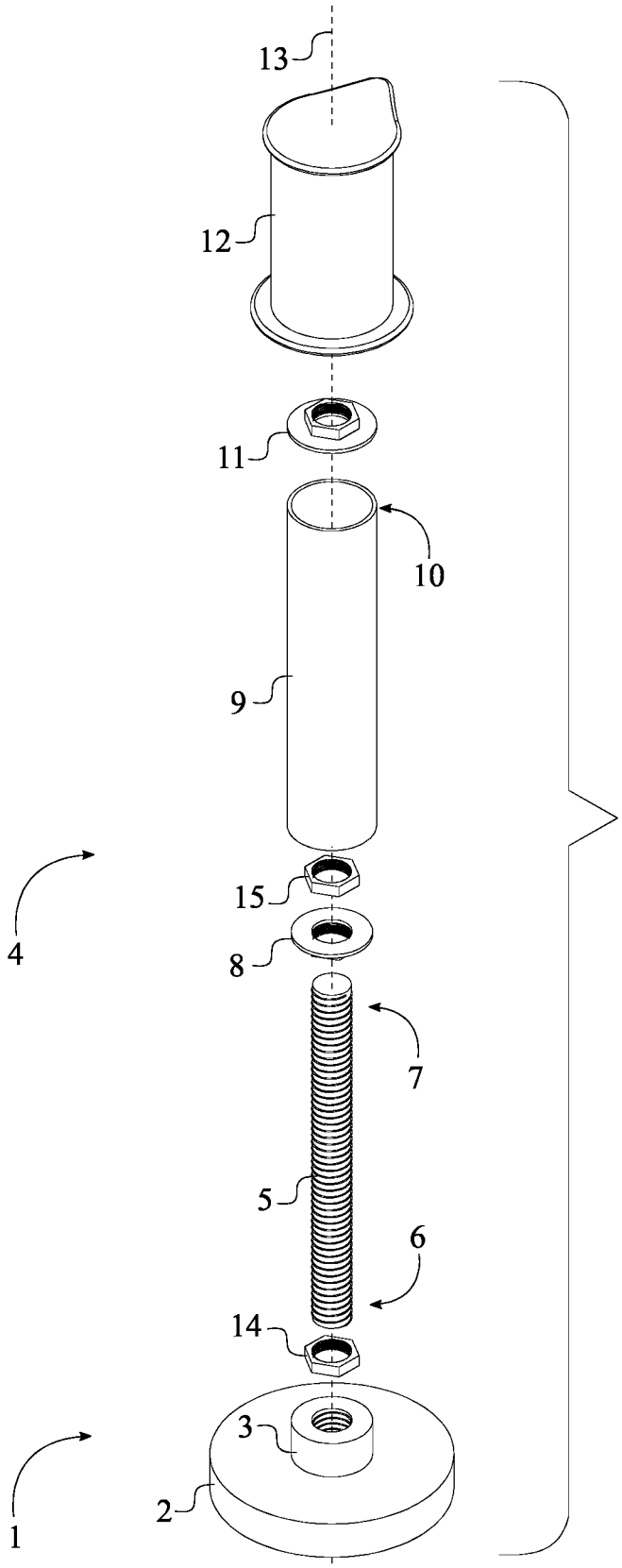
FIG. 2 is an exploded view of the present invention.

The present invention is a magnetic clamping apparatus to clamp ferrous items together while also being able to hold heavy components together. The present invention provides an upgraded clamping mechanism in comparison to a mechanical clamp as the magnetic clamping force can be easily, quickly, and efficiently utilized against the ferrous items by a construction worker. The present invention comprises a magnetic base 1, a handle 4, a grip 12, a central axis 13 as shown in FIG. 1-2. The magnetic base 1 that fasten ferrous or non-ferrous items to a secondary ferrous item comprises a magnet body 2 and a mounting body 3 as shown in FIG. 1-2.

Figure 5:
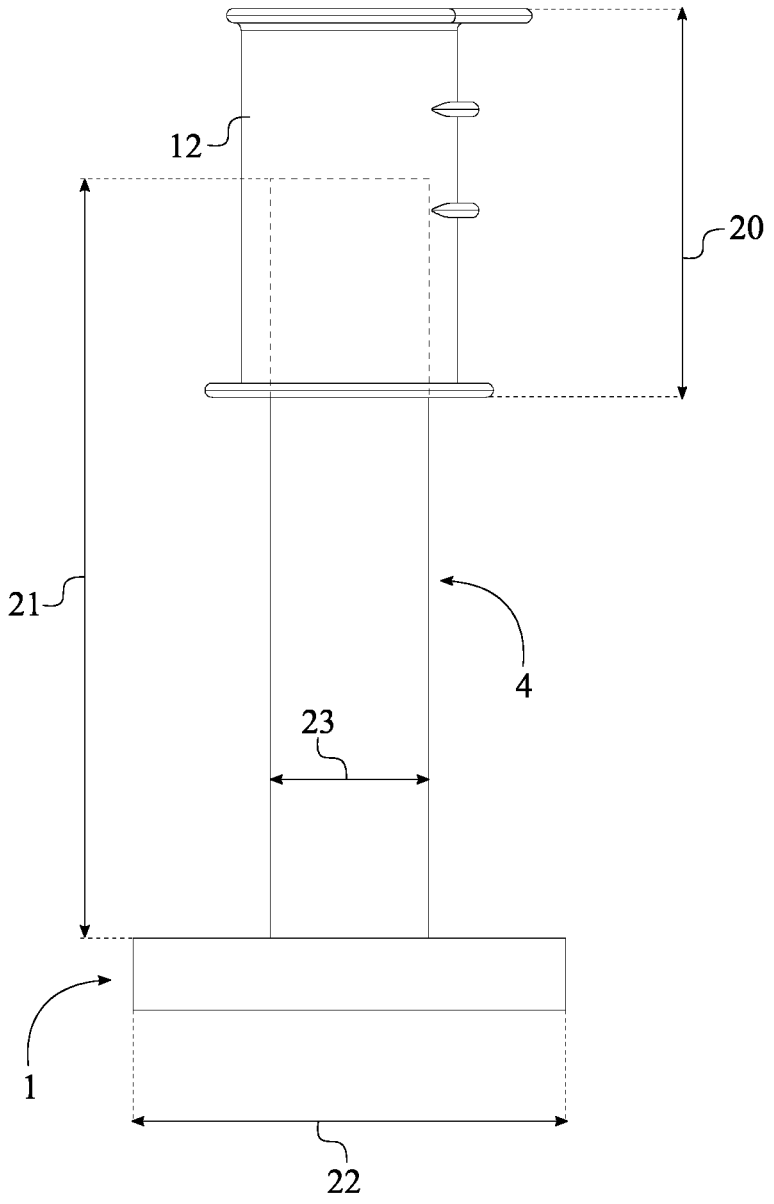
FIG. 5 is a side view of the present invention, showing the height of the grip, the height of the handle, the diameter of the handle, and the diameter of the magnet body.

In reference to a general configuration of the present invention, the handle 4 and the magnetic base 1 are concentrically positioned around the central axis 13 thus providing an elongated configuration. The mounting body 3 is concentrically connected onto the magnet body 2 so that the mounting body 3 can function as a connector in between the magnet body 2 and the handle 4. As a result, the handle 4 is terminally connected to the mounting body 3 so that the present invention can be controlled during attachment and removal process. The grip 12 is connected around the handle 4 thus allowing the user to grasp the present invention easily and comfortably. As shown in FIG. 5, a diameter 22 of the magnet body 2 is larger than a diameter 23 of the handle 4 so that the magnet body 2 is able to provide maximum surface area for the adhesion of the ferrous items.

In reference to FIG. 2, the magnet body 2 functions as the magnetic surface in which allows the user to attach the present invention onto the ferrous items. The magnet body 2 is preferably a neodymium magnet so that the present invention is able to provide a strong magnetic field to hold heavy ferrous items. However, the magnet body 2 is not limited the neodymium magnet and can be any other types of magnets with the strong magnetic field. Furthermore, the diameter 22 of the magnet body 2 ranges from 2 inches to 5 inches so that the present invention can comply industry standard ferrous beams. Furthermore, an adhesion force of the magnet body 2 is greater than 400 pounds. The mounting body 3 is a cylindrical threaded bung so that the handle 4 can be easily connected to the magnet body 2 without compromising the magnetic properties. A diameter of the mounting body 3 is smaller than the diameter 22 of the magnet body 2 since the diameter 23 of the handle 4 is smaller than the diameter of the magnet body 2.

Figure 3:
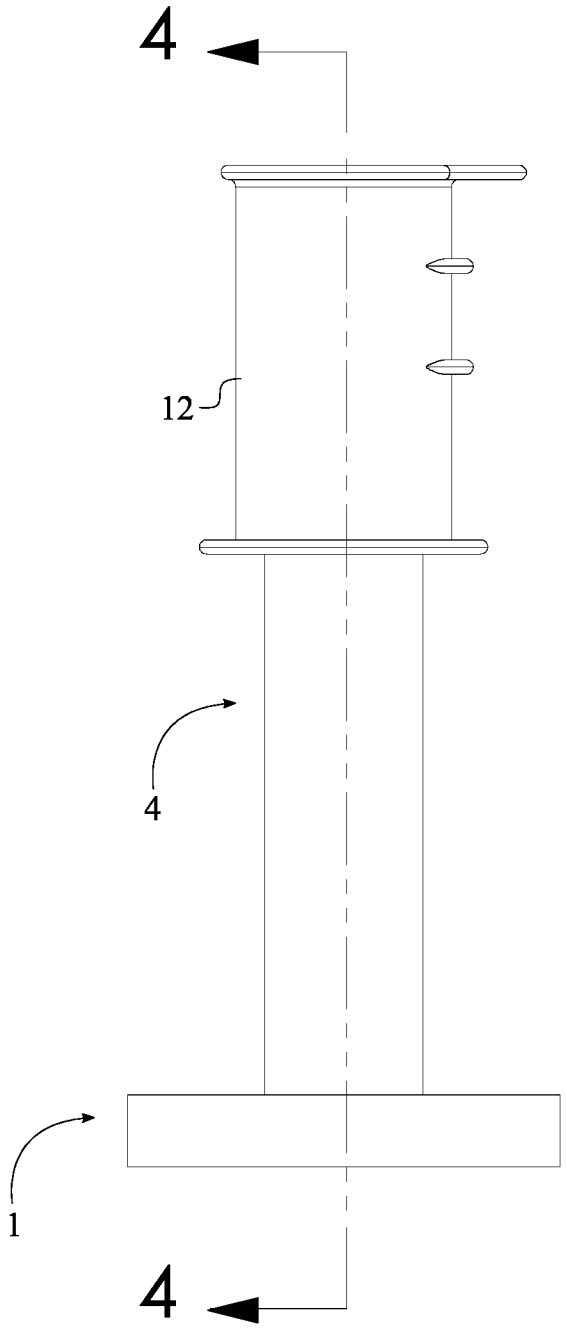
FIG. 3 is a side view of the present invention, showing the plane upon which a cross sectional view is taken shown in FIG. 4.
Figure 4:
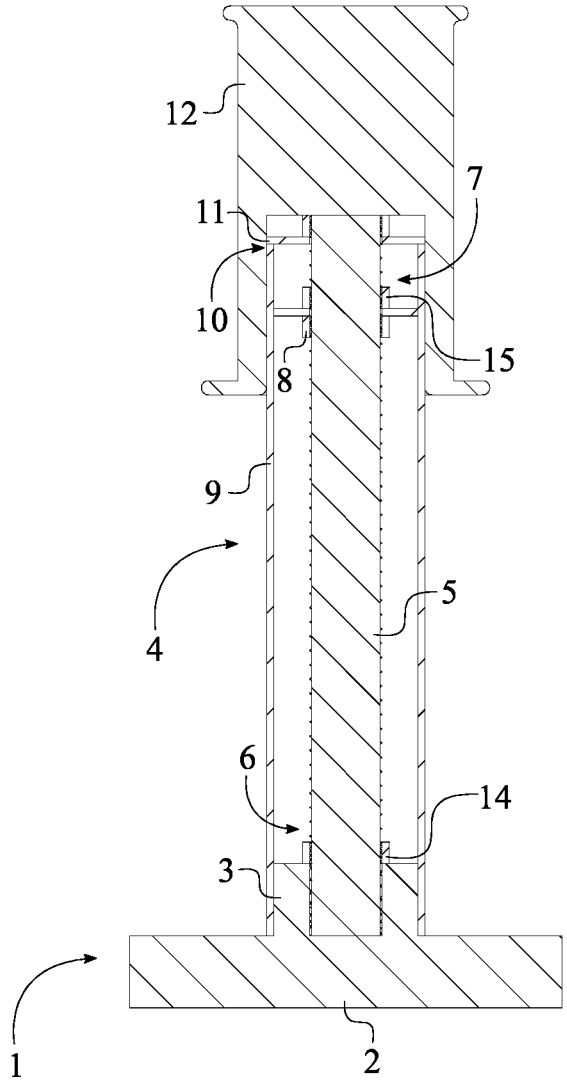
FIG. 4 is a cross section view of the present invention taken along line 4-4 of FIG. 3.

In reference to FIG. 3-4, the handle 4 comprises a shaft 5, a spacer 8, an outer sleeve 9, and a cap 11. Aforementioned components are able to structurally strengthen the handle 4 to compensate for the adhesion force of the magnet body 2 and provide the aesthetic appearance for the present invention. A first end 6 of the shaft 5 is terminally connected to the mounting body 3. More specifically, the first end 6 of the shaft 5 and the mounting body 3 are connected to each other through a threaded connection. The spacer 8 and the mounting body 3 are oppositely positioned from each other about the shaft 5 as the spacer 8 is terminally connected to a second end 7 of the shaft 5. The spacer 8 provide radial support for the placement of the outer sleeve 9 and eliminate lateral movement of the outer sleeve 9. The outer sleeve 9 is concentrically positioned around the spacer 8 and provides a clean outer surface for the handle 4. The mounting body 3 and the spacer 8 are encircled by the outer sleeve 9 so that the lateral movement of the outer sleeve 9 with respect to the first end 6 and the second end 7 can be eliminated. The cap 11 is pressed against a free end 10 of the outer sleeve 9 and terminally connected around the second end 7 of the shaft 5. As a result, the outer sleeve 9 and the cap 11 are able to hide the mounting body 3, the shaft 5, and the spacer 8 thus providing the aesthetic appearance for the present invention. Furthermore, configuration and the connection of the mounting body 3, the shaft 5, the spacer 8, the outer sleeve 9, and the cap 11 are able to structurally strengthen the handle 4. Furthermore, a height 21 of the handle 4 ranges from 7 inches to 10 inches in order to provide sufficient leverage for the attachment and the removal of the present invention.

In reference to FIG. 2 and FIG. 4, the present invention further comprises a first locking nut 14. More specifically, the first locking nut 14 is connected around the first end 6 of the shaft 5 and positioned adjacent to the mounting body 3. Connection of the first locking nut 14 prevents the shaft 5 from backing out of the mounting body 3 as the first locking nut 14 is pressed against the mounting body 3. A diameter of the first locking nut 14 is smaller than the diameter of the mounting body 3 so that the first locking nut 14 does not obstruct the placement of the outer sleeve 9.

In reference to FIG. 2 and FIG. 4, the present invention further comprises a second locking nut 15. More specifically, the second locking nut 15 is connected around the second end 7 of the shaft 5 and positioned adjacent to the spacer 8. Connection of the second locking nut 15 prevents the axial movement of spacer 8 as the second locking nut 15 is pressed against the spacer 8 and positioned in between the spacer 8 and the cap 11. A diameter of the second locking nut 15 is smaller than a diameter of the spacer 8 so that the second locking nut 15 does not obstruct the placement of the outer sleeve 9. Optionally, the second locking nut 15 and the second end 7 of the shaft 5 may be punched with a plurality of holes to prevent the second locking nut 15 from loosening over time.

In reference to FIG. 4, the grip 12 is connected to the outer sleeve 9 to provide an ergonomic surface area for the user grasp the present invention. More specifically, the grip 12 may be manufactured of a rubber or plastic and may have a textured surface to improve the grasp of the user and provides structure to a malleable grip 12. The grip 12 may also comprise a plurality of ergonomic protrusions to improve the grasp of the user. Furthermore, a height 20 of the grip 12 is less than the height 21 of the handle 4. In other words, the grip 12 only extends about halfway through the handle 4 thus exposing the outer sleeve 9 from the magnet body 2 to the grip 12.

Liquid adhesive can be integrated into all the connection points of the present invention to prevent any movement of the components overtime. For example, a liquid adhesive can be utilized with the connection of the first end 6 of the shaft 5 and the mounting body 3.

Although the invention has been explained in relation to its preferred embodiment, it is to be understood that many other possible modifications and variations can be made without departing from the spirit and scope of the invention as hereinafter claimed.

What is claimed is:

1. A magnetic clamping apparatus comprising:
a magnetic base;
a handle;
a grip;
a central axis;
the magnetic base comprising a magnet body and a mounting body;
the handle and the magnetic base being concentrically positioned around the central axis;
the mounting body being concentrically connected onto the magnet body;
the handle being terminally connected to the mounting body;
the grip being connected around the handle;
a diameter of the magnet body being larger than a diameter of the handle;
the handle comprising a shaft, a spacer, an outer sleeve, and a cap;
a first end of the shaft being terminally connected to the mounting body;
the spacer and the mounting body being oppositely positioned from each other about the shaft;
the spacer being terminally connected to a second end of the shaft;
the outer sleeve being concentrically positioned around the spacer;
the mounting body and the spacer being encircled by the outer sleeve;
the cap being pressed against a free end of the outer sleeve; and
the cap being terminally connected around the second end of the shaft.

2. The magnetic clamping apparatus as claimed in claim 1 comprising:
a first locking nut;
the first locking nut being connected around the first end of the shaft;
the first locking nut being positioned adjacent to the mounting body; and
the first locking nut being pressed against the mounting body.

3. The magnetic clamping apparatus as claimed in claim 1 comprising:
a second locking nut;
the second locking nut being connected around the second end of the shaft;
the second locking nut being positioned adjacent to the spacer; and
the second locking nut being positioned in between the spacer and the cap.

4. The magnetic clamping apparatus as claimed in claim 1 comprising:
the handle comprising an outer sleeve; and
the grip being connected to the outer sleeve.

5. The magnetic clamping apparatus as claimed in claim 1, wherein a height of the grip is less than a height of the handle.

6. The magnetic clamping apparatus as claimed in claim 1, wherein the magnet body is a neodymium magnet.

7. The magnetic clamping apparatus as claimed in claim 1, wherein an adhesion force of the magnet body is greater than 400 pounds.

8. The magnetic clamping apparatus as claimed in claim 1, wherein a diameter of the magnet body ranges from 2 inches to 5 inches.

9. The magnetic clamping apparatus as claimed in claim 1, wherein a height of the handle ranges from 7 inches to 10 inches.

* * * * *